US005819139A

United States Patent [19]

Harlan et al.

[11] Patent Number: 5,819,139

[45] Date of Patent: Oct. 6, 1998

[54] COOPERATING LATCH AND HANDLE FOR A COPIER SUBSYSTEM

[75] Inventors: Andrij Harlan; Eugene J. Fina, both of Rochester; Douglas W. Sass, Ontario, all of N.Y.

[73] Assignee: Xerox Corporation, Stamford, Conn.

[21] Appl. No.: 834,006

[22] Filed: Apr. 11, 1997

[51] Int. Cl.[6] ..... G03G 15/00

[52] U.S. Cl. ..... 399/110; 312/332.1

[58] Field of Search ..... 399/108, 110, 399/111, 113, 115, 116, 118, 119, 121–124; 222/210, 465.1, 469; 101/374; 352/72–74; 312/298, 332.1, 333, 348.6

[56] References Cited

U.S. PATENT DOCUMENTS

| | | | |
|---|---|---|---|
| 3,120,412 | 2/1964 | Caldwell . | |
| 3,563,628 | 2/1971 | Poe . | |
| 3,619,019 | 11/1971 | Hepker . | |
| 4,174,172 | 11/1979 | Lane . | |
| 4,256,356 | 3/1981 | Roth . | |
| 4,866,483 | 9/1989 | Davis et al. . | |
| 4,891,676 | 1/1990 | Davis et al. . | |
| 4,943,828 | 7/1990 | Manabe et al. | 399/113 |
| 5,162,852 | 11/1992 | Ikeda | 399/119 |
| 5,201,852 | 4/1993 | Ogoshi | 432/60 |
| 5,204,713 | 4/1993 | Yamamura | 399/119 |
| 5,208,639 | 5/1993 | Thayer et al. . | |
| 5,237,377 | 8/1993 | Harada et al. . | |
| 5,386,282 | 1/1995 | Palmer et al. . | |
| 5,396,320 | 3/1995 | Lange . | |
| 5,442,422 | 8/1995 | Owens, Jr. et al. . | |
| 5,579,101 | 11/1996 | Oamata et al. | 399/114 |
| 5,585,889 | 12/1996 | Shishido et al. . | |

*Primary Examiner*—Robert Beatty
*Attorney, Agent, or Firm*—John S. Wagley

[57] ABSTRACT

A slidable subsystem for use in a printing machine is provided. The subsystem includes a body slidably mounted to the printing machine, a handle connected to the body, and a lever. The lever is operably associated with the body. The lever selectively secures the body to the printing machine. The lever is moveable into a first relaxed position and a second secured position. The lever cooperates with said handle to permit the handle to be extended forwardly when the lever is in a relaxed position.

18 Claims, 4 Drawing Sheets

COOPERATING LATCH AND HANDLE FOR A COPIER SUBSYSTEM

This invention relates generally to a customer replaceable unit (CRU) for a printing machine, and more particularly concerns a xerographic module for an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, a CRU is a customer replaceable unit which can be replaced by a customer at the end of life or at the premature failure of one or more of the xerographic components. The CRU concept integrates various subsystems whose useful lives are predetermined to be generally the same length. The service replacement interval of the CRU insures maximum reliability and greatly minimizes unscheduled maintenance service calls. Utilization of such a strategy, allows customers to participate in the maintenance and service of their copiers/printers. CRUs insure maximum up time of copiers and minimize downtime and service cost due to end of life or premature failures.

It is desirable to have a CRU that enables a variety of machine subsystems to be incorporated into a single unit while maximizing the useful life of each component. It is further desirable to utilize a CRU that allows service to a machine to be performed efficiently and at a relatively low cost and in some cases to be serviced by the user himself. It is a further benefit to have the ability to reuse and recycle various CRU components in today's climate of environmental awareness.

It is desirable to provide for easy installation and removal of the CRU units from the printing machine. Typically, the CRUs are configured so that they may either be lowered into an upper portion of the printing machine, or particularly for xerographic CRUs, or other larger CRUs, the CRU is slid horizontally into position in the machine. Because the xerographic CRU may mate with other critical portions of the machine which may be damaged and because the position of the CRU is critical for the proper operation of the copy machine, proper installation of the CRU is critical. Furthermore, for large xerographic CRUs which contain either waste toner or new toner, the xerographic unit CRU may be large, cumbersome and heavy. Therefore, it is important to provide a CRU which may be easily and safely secured by an operator during installation and removal. Further, it is important that the xerographic CRU unit is released prior to removal and that the operator's hands be utilized to hold the large bulky and heavy CRU.

This invention is directed to alleviate at least some of the aforementioned problems.

The following disclosures may relate to various aspects of the present invention.

US-A 4,174,172
Patentee: Lane
Issue Date: November 13, 1979
US-A 4,866,483
Patentee: Davis et al.
Issue Date: September 12, 1989
US-A 4,891,676
Patentee: Davis et al.
Issue Date: January 2, 1990
US-A 5,208,639
Patentee: Thayer et al.
Issue Date: May 4, 1993
US-A 5,237,377
Patentee: Harada et al.
Issue Date: August 17, 1993
US-A 5,386,282
Patentee: Palmer et al.
Issue Date: January 31, 1995
US-A 5,396,320
Patentee: Lange
Issue Date: March 7, 1995
US-A 5,442,422
Patentee: Owens, Jr. et al.
Issue Date: August 15, 1995

Some portions of the foregoing disclosures may be briefly summarized as follows:

U.S. Pat. No. 4,174,172 discloses a method and apparatus for cleaning a surface. The surface is moved in one direction relative to a cleaning blade in engagement therewith. Rest periods are provided of no relative motion wherein the blade is moved out of contact with the surface at a first position during the period of no relative motion.

U.S. Pat. No. 4,866,483 discloses an improved cleaning station for use in a print engine having cleaning elements. The photoreceptor belt cleaning station is positioned in front of the print engine and the photoreceptor medium is positioned in the other frame of the print engine so that the cleaning station is directly accessible when the print engine is open.

U.S. Pat. No. 4,891,676 discloses an improved cleaning station for use in a print engine having cleaning elements. The transfer medium cleaning station is equipped with a locking mechanism that allows inserting the cleaning station and removing it from the print engine without scraping the transfer medium with the cleaning element.

U.S. Pat. No. 5,208,639 discloses an apparatus for cleaning residual toner that includes a multiple turret style blade holder located such that an individual blade is selectively indexed into optimum position.

U.S. Pat. No. 5,237,377 discloses a cleaning device for a dry printing device which includes a cleaning brush brought into resilient contact with a photosensitive drum. A rotational direction switching mechanism switches the rotation of the brush.

U.S. Pat. No. 5,386,282 discloses an apparatus for retraction and engaging the cleaning blade from the imaging surface and preventing copy reprint. At least one of the two momentary switches are depressed by one of at least two lobes on a motorized cam.

U.S. Pat. No. 5,396,320 discloses an electrostatic printer having a cleaning blade for removing residual particles from the surface of a photoconductive substrate. A mechanism automatically retracts the cleaning blade away from the substrate to avoid scraping the blade against a seam on the substrate.

U.S. Pat. No. 5,442,422 discloses an apparatus for cleaning the imagining surface of a printer. The contamination seal captures all accumulated toner from the blade edge and in the brush nip due to gravity.

In accordance with one aspect of the present invention, there is provided a slidable subsystem for use in a printing machine. The subsystem includes a body slidably mounted to the printing machine, a handle connected to the body, and a lever. . The lever is operably associated with the body. The lever selectively secures the body to the printing machine. The lever is moveable into a first relaxed position and a second secured position. The lever cooperates with said handle to permit the handle to be extended forwardly when the lever is in a relaxed position.

Pursuant to another aspect of the present invention, there is provided a customer replaceable unit for use in a printing machine. The printing machine includes a lever. The customer replaceable unit includes a body slidably mounted to the printing machine and a handle connectable to the body and to the lever. The lever selectively secures the body to the printing machine. The lever is moveable into a first relaxed position and a second secured position. The lever cooperates with said handle to permit the handle to be extended forwardly when the lever is in a relaxed position.

Pursuant to yet another aspect of the present invention, there is provided an electrophotographic printing machine of the type including a customer replaceable unit. The printing machine includes a lever. The customer replaceable unit includes a body slidably mounted to the printing machine and a handle connectable to the body and to the lever. The lever selectively secures the body to the printing machine. The lever is moveable into a first relaxed position and a second secured position. The lever cooperates with said handle to permit the handle to be extended forwardly when the lever is in a relaxed position.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 3:
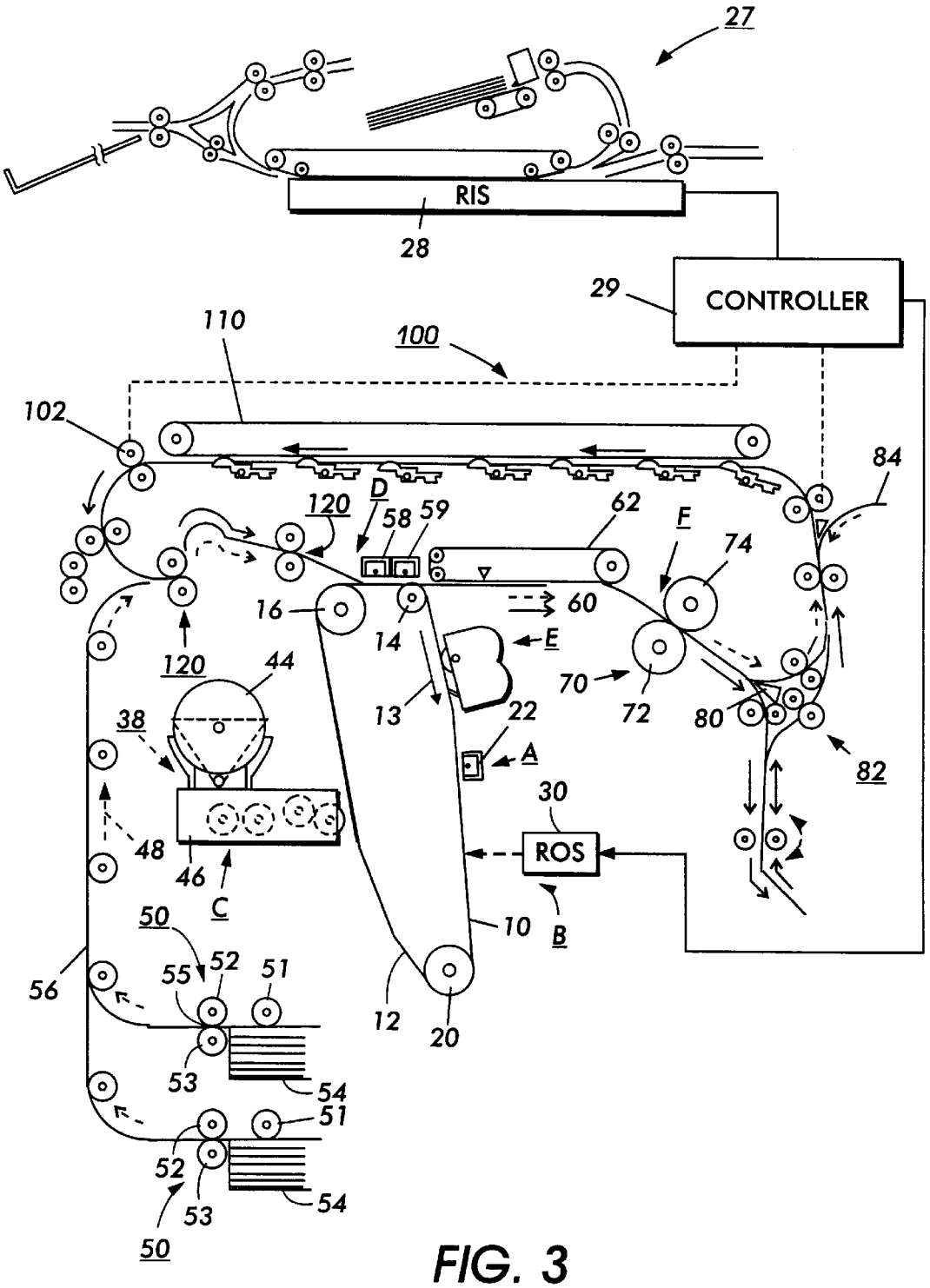
FIG. 3 is a schematic elevational view of a typical electrophotographic printing machine utilizing the cooperating latch and handle of the present invention.

For a general understanding of the features of the present invention, reference is made to the drawings. In the drawings, like reference numerals have been used throughout to identify identical elements. FIG. 3 schematically depicts an electrophotographic printing machine incorporating the features of the present invention therein. It will become evident from the following discussion that the cooperating latch and handle of the present invention may be employed in a wide variety of devices and is not specifically limited in its application to the particular embodiment depicted herein.

Referring to FIG. 3 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 3 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 3, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc.. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 4:
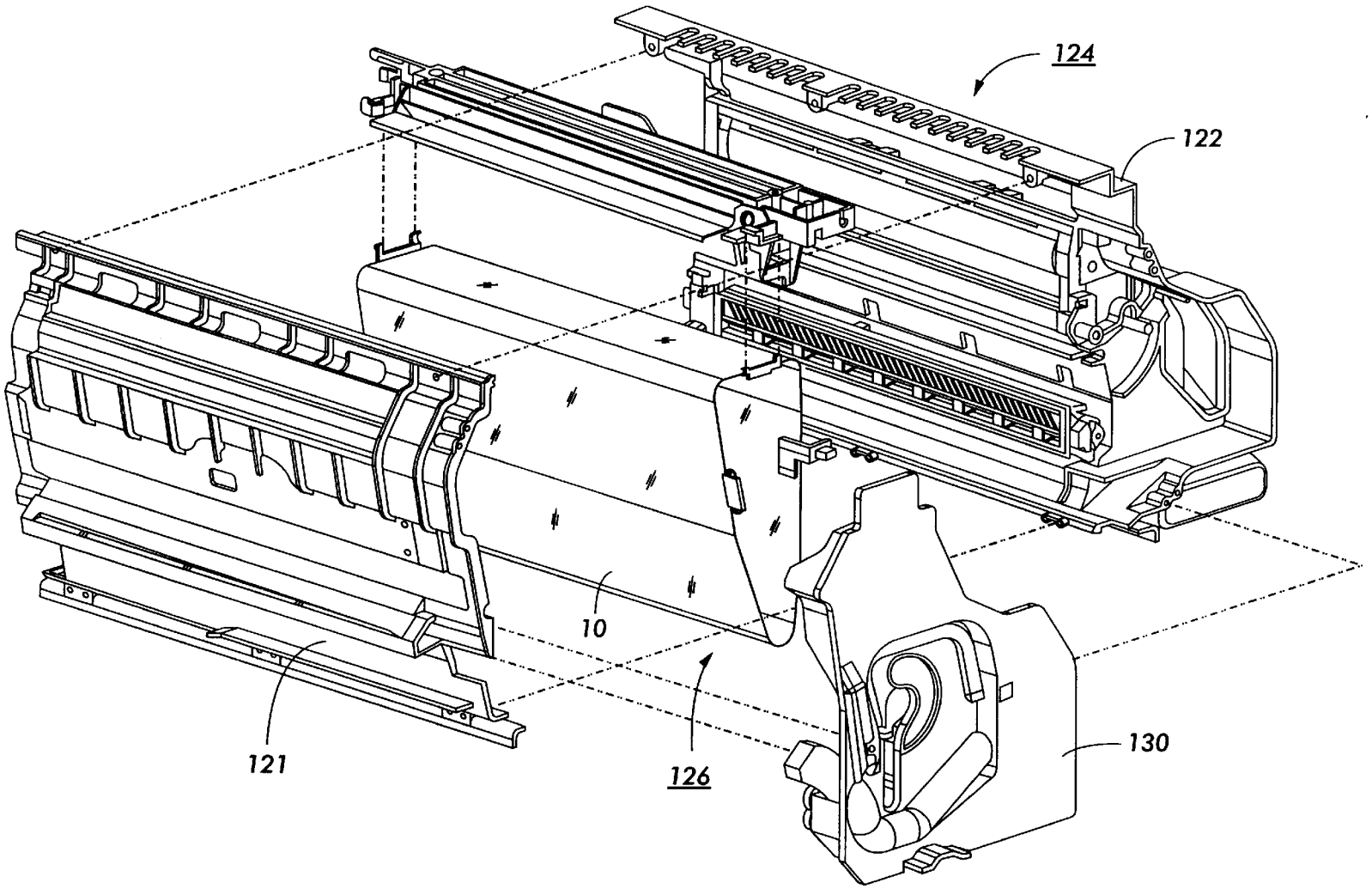
FIG. 4 is a schematic elevational view of a CRU for use with the printing machine of FIG. 3 utilizing the cooperating latch and handle of the present invention.

Turning next to FIG. 4, there is illustrated a perspective view of the xerographic CRU 124. The xerographic CRU module mounts and locates xerographic subsystems in relationship to the photoreceptor module and xerographic subsystem interfaces. Components contained within the xerographic CRU include the transfer/detack corona generating devices, the pretransfer paper baffles, the photoreceptor cleaner, the charge scorotron, the erase lamp, the photoreceptor(photoreceptor) belt, the noise, ozone, heat and dirt (NOHAD) handling manifolds and filter, the waste bottle, the drawer connector, CRUM, the automatic cleaner blade engagement/retraction and automatic waste door open/close device.

A summary of the xerographic CRU components and the function of each is as follows:

Cleaner (Doctor blade and Disturber Brush): remove untransferred toner from the photoreceptor; transport waste toner and other debris to a waste bottle for storage; assist in controlling the buildup of paper talc, filming and comets on the photoreceptor belt.

Precharge Erase Lamp: provides front irradiation of the photoreceptor to the erase the electrostatic field on the surface Charge Pin Scorotron: provides a uniform charge level to the photoreceptor belt in preparation for imaging.

Photoreceptor Belt: charge retentive surface advances the latent image portions of the belt sequentially through various xerographic processing stations which converts electrostatic field on the surface Pretransfer Paper Baffles: directs and controls tangency point between the paper and photoreceptor surface. Creates an "S" bend in paper to flatten sheet in the transfer zone.

Transfer Wire Corotron: places a charge on the paper as in passes under the corotron. The high positive charge on the paper causes the negative charged toner to transfer from the photoreceptor to the paper.

Detack Pin Corotron: assist in removing paper with its image from the photoreceptor by neutralizing electrostatic fields which may hold a sheet of paper to photoreceptor. Sheet self strips as it passes over a stripper roll on belt module.

NOHAD Dirt Manifolds and Filter: removes airborne toner dirt and contaminates from the moving air before it leaves the CRU. The captured toner and contaminates are deposited in a dirt filter contained in the xerographic CRU.

Electrical Drawer Connector: provides connector interface for he CRUM; provides input/output for machine control.

CRUM Chip: allows machine to send reorder message (user interface or automatically) for CRU or other; method to monitor number of copies purchased by the customer and warrantee the CRU for premature CRU failures; provides handshake feature with machine to ensure correct CRU installed in compatible machine; shuts down machine at the appropriate CRU kill point;

enables market differentiation; enables CRU life cycle planning for remanufacture; enables remote diagnostics; provides safety interlock for the ROS.

ROS and Developer Interface: provides a developer interface window to allow transfer of toner for imaging from developer donor roll to photoreceptor belt surface latent image; Also, provides critical parameter mounting and location link which ties ROS to photoreceptor module to ensure proper imaging and eliminate motion quality issues.

BTAC Sensor Interface: provides interface window to monitor process controls.

Registration Transport Interface: provides outboard critical parameter location and mounting feature.

Prefuser Transport Interface: provides critical parameter location and mounting feature.

The CRU subsystems are contained within the xerographic housing. The housing consist of three main components which include the front end cap 130, right side housing 122 and left side housing 121. The xerographic housing is a mechanical and electrical link. It establishes critical parameters by mounting and locating subsystems internal and external to the CRU in relationship to the photoreceptor module and other xerographic subsystem interfaces. The housing allows easy reliable install and removal of the xerographic system with out damage or difficulty.

The front end cap joins the right and left side housings together on the outboard end of the CRU. The front end cap also functions as a mechanical link with features which mount and locate on the outboard of the machine the photoreceptor module, ROS and registration transport in relationship to one another in order to achieve mechanical critical parameters. The end cap also mounts spring loaded slide, waste door pivot and blade pivot links which allows the customer to simultaneously engage and disengage the cleaner waste door and blade during install and removal of the CRU when the photoreceptor module handle is rotated. When removed from the machine, the blade pivot link insures the cleaner blade remains retracted to prevent photoreceptor belt and blade damage during CRU install and removal. The waste door pivot link secures the cleaner waste bottle door closed when the CRU is removal to prevent spillage of toner during shipping. The end cap also mounts a dirt manifold which links the left side housing developer manifold with the NOHAD dirt filter in the right side housing. The manifolds transport airborne toner and other contaminates to the dirt filter by means of an airflow stream.

The right side housing mounts and locates a number of the xerographic subsystems and interfaces internal and external to the CRU. The right side housing mounts one half of the transfer and detack assembly, charge scorotron, photoreceptor belt and drawer connector. These components are allow to float within the CRU housing. They achieve critical parameter locations with the photoreceptor module and machine frame when the CRU housing is fully installed and the photoreceptor module handle engages the tension roll. Both the charge scorotron and transfer/detack subsystem are located by means of spring loads located on the photoreceptor module.

The right side housing also contains molded scorotron retention features and mounts and locates a charge spring which retracts the charge scorotron subsystem to the housing when the CRU is removed from the machine. The spring enables successful install and removal of the CRU without damage to the charge scorotron.

The right side housing has molded ports in the charge scorotron mounting area to allow non-contaminated air to flow over the charge device in order to remove any contaminates which would affect the performance of the unit. i.e. (nitrous oxide a cause of parking deletions).

The right side housing features molded vents at the transfer/detack location. The vents also allow sufficient air over the transfer and detack devices to prevent any nitrous oxide contamination.

The housing has special molded features which mount and locate the cleaner assembly, precharge erase lamp, waste bottle and NOHAD air duct and filter. The right housing mounts and locates the interfaces of the cleaner blade and waste door pivot features. The housing positions the NOHAD air duct and filter to the blower to allow sufficient airflow to capture airborne contaminates and toner.

The photoreceptor belt 10 is partially retained by molded fingers with are located on the inboard and outboard areas of the right housing. Other retaining belt fingers are located on the transfer detack housing and left side housing. The housing has a molded feature at the lower outboard end which positions the belt on the photoreceptor module 126 to prevent belt damage.

The left side housing serves as protective cover for the photoreceptor belt and provide interface windows with various subsystems surrounding the CRU. The interface windows include the BTAC, developer and ROS. The housing also mounts one half of the transfer detack subsystem. It also provides an interface window with the registration transport for the entry of paper. The developer dirt manifold is also mounted and located on the left side housing. Two of the belt retaining fingers and a molded feature at the lower outboard end retain and position the photoreceptor belt during install and removal. The left side housing has a molded baffle which covers ROS on outboard end to prevent customer exposure to the ROS beam.

The integrated CRU housing ramps the registration transport and prefuser transport into position when the unit is installed in the machine. The CRU housing makes 22 critical mechanical and electrical interfaces almost simultaneously. All the housings possess double bosses which allows the unit to be secured together during the manufacturing build. If both bosses happen to strip out over time, a longer screw can be used to secure the parts due to sufficiently deep bosses.

Figure 1:
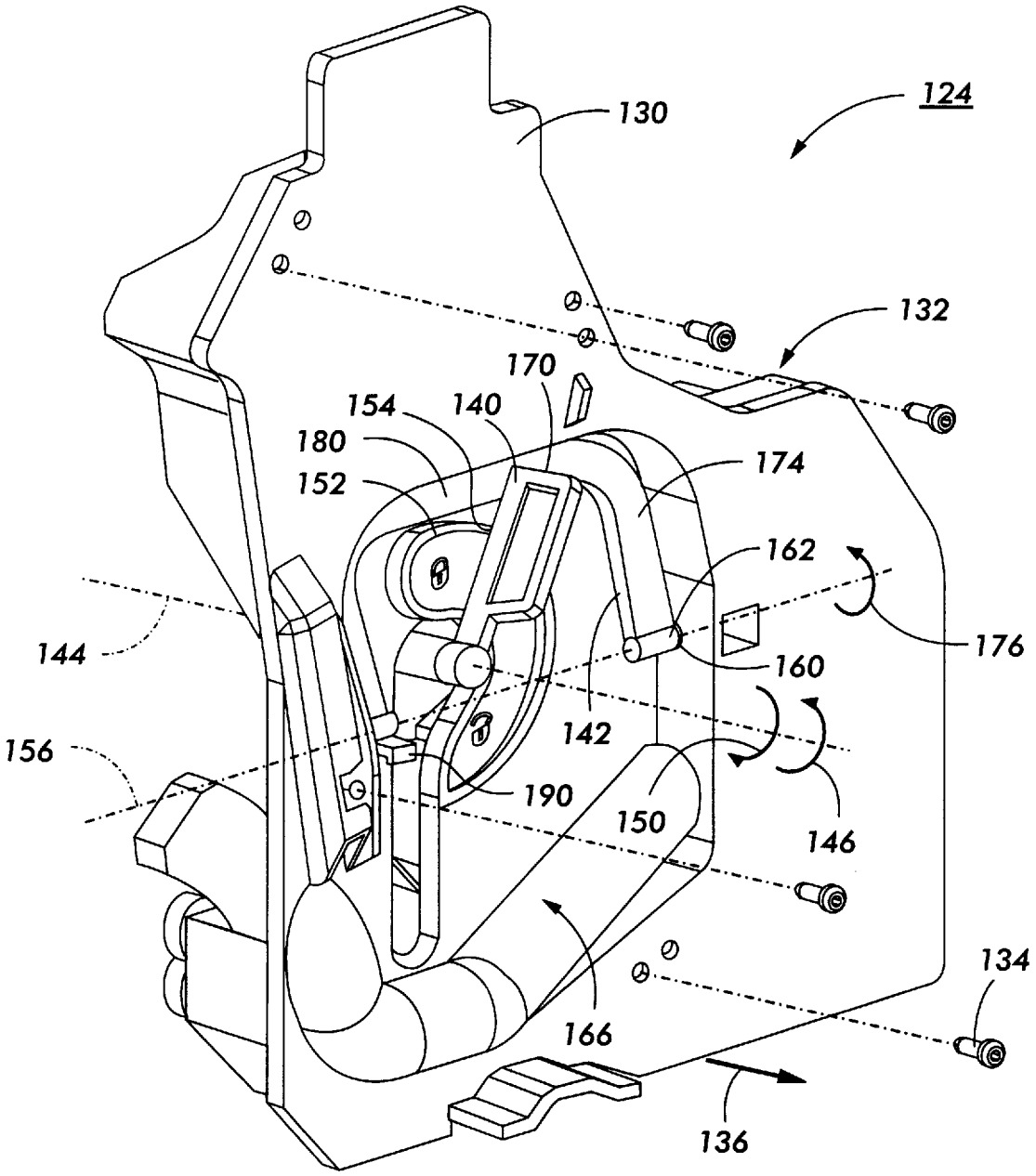
FIG. 1 is a perspective view of a front cover of a xerographic CRU incorporating the cooperating latch and handle of the present invention in the latched position.

According to the present invention and referring to FIG. 1, the front cover 130 of the xerographic CRU 124 as shown in FIG. 4 is illustrated showing the cooperating latch and handle of the present invention. While as shown in FIG. 1, the cooperating latch and handle mechanism 132 is shown secured to front cover 130 of the xerographic CRU 124 it should be appreciated that the xerographic CRU 124 may be made of an integral case (not shown) in which the front of the CRU would be part of the integral housing. It should also be appreciated that the mechanism 132 as shown in FIG. 1 may be incorporated in any customer replaceable unit for a printing machine or for any other subassembly of the printing machine which will require removal from the machine or to be separated from the machine to provide access for components thereunderneath.

The front cover 130 may be made of any suitable durable material. Preferably the front cover 130 is made of a material that is inexpensive and that may be recycled in order that the CRU may be recycled. The front cover 130 may for example be made of plastics. For example, polystyrene. The front cover 130 may be secured to the CRU 124 in any suitable fashion, e.g. by glue, welding or by fasteners. For example, as shown in FIG. 1, the front cover 130 is secured by self tapping screws 134. The CRU 124 is preferably removed from the printing machine (not shown) by sliding CRU 124 in the direction of arrow 136. To permit easy removal of the CRU 124 from the machine, preferably, the CRU 124 includes the mechanism 132 a portion of which is secured to front cover 130. The mechanism 132 provides for a feature which the operator may grab to permit the sliding of the CRU 124 in the direction of arrow 136.

The mechanism 132 serves to provide a feature for assisting in the removal of the CRU 124 in the direction of arrow 136. A portion of the mechanism 132 is secured to the front cover 130. The mechanism 132 includes a first handle or latch 140 as well as a second latch or handle 142. The latch 140 and the handle 142 cooperate to provide a mechanism for assisting in the removal of CRU 124 from the copy machine. The latch 140 is preferably secured rotatably to the printing machine about centerline 144. The latch 140 is pivotable about centerline 144 and, when rotated in the direction of arrow 146, is placed in locked position as shown in FIG. 1. When the latch 140 is rotated in the direction of arrow 150, the latch is permitted to move into the unlocked position as shown FIG. 2.

Referring again to FIG. 1, the latch 140 may be made of any suitable durable recyclable material. For example, the latch 140 may be made of plastics. Because of the forces placed upon the latch 140, the latch is made of glass filled polycarbonate. The latch 140 may have any suitable size and shape capable of sufficient strength for operation of the latch. Preferably to provide the securing of the latch 140 into the locked position, the front cover 130 includes a cam surface 152. The cam surface 152 mates with inside face 154 of the latch to provide an interference lock for the latch 140 in the upward position.

To assist in the removal of the CRU 124, preferably, the mechanism 132 includes handle 142. To protect the handle 142 during operation of the machine and to provide clearance within the machine, the handle 142 preferably has a restrained position as shown in FIG. 1 in which the handle 142 is positioned close to the front cover 130 and is restrained between the handle 142 and the cover 130. Preferably, the handle 142 is pivotally secured to the front cover 130 along door pivot axis 156. The handle 142 may be pivotally connected to the cover 130 in any suitable fashion, but preferably the handle 142 includes journals 160 which extend along axis 156 and cooperate with apertures 162 integrally molded within the front cover 130.

As shown in FIG. 1, when the CRU is in the installed position, the handle 142 may be stored in a vertical and restrained position within recess 166 of the front cover 130. To secure the handle 142 in its stored position, preferably, the latch 140 extends outwardly such that the distal end 170 of the latch 140 extends beyond the handle 142. Thus, as the latch 140 is rotated in the direction of arrow 146, the distal end 172 of the handle contacts front face 174 of the handle 142 causing it to rotate in the direction of arrow 176 such that inner face 180 of the handle 142 rests against recess 166.

Figure 2:
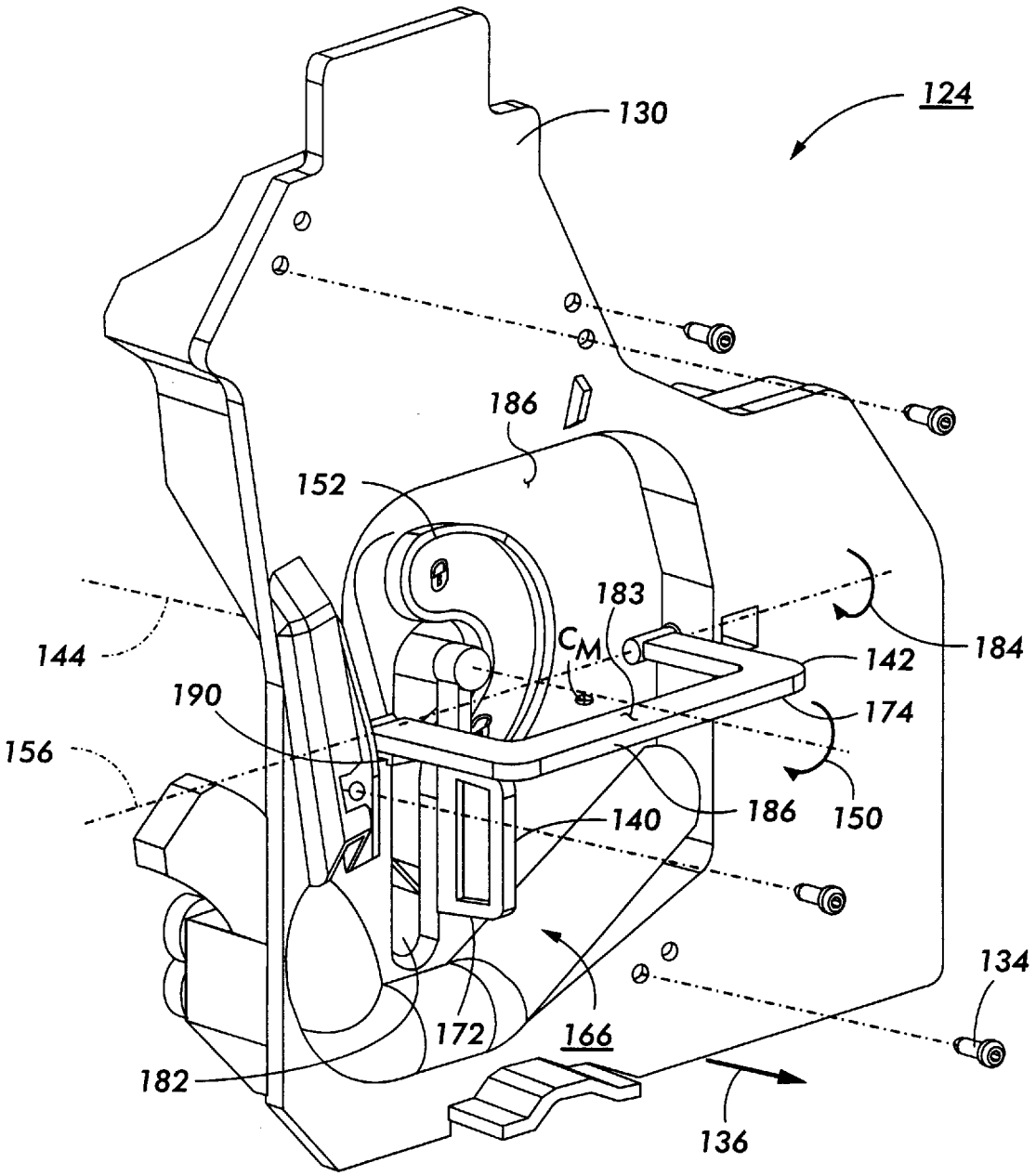
FIG. 2 is a perspective view of the front cover of FIG. 1 showing the cooperating latch and handle of the present invention in the unlatched position.

Referring now to FIG. 2, the front cover 130 of the CRU 124 is shown with the latch 140 in the unlocked position. In this position, the latch 140 has been rotated in the direction of arrow 150 such that distal end 172 of the latch 140 is in a generally downward position. The front cover 130 preferably includes a slot 182 which has a shape similar to the latch 140. The opening 182 permits the CRU to be removed in the direction of arrow 136 while the latch 140 remains within the printing machine. As the latch 140 is rotated in the direction of arrow 150, the distal end 172 of the latch 140 is separated from front face 174 of the handle 142. Since the latch 140 no longer restrains the handle 142, the handle 142 falls by gravity in the direction of arrow 184 so that the handle 142 extends outwardly in a generally horizontal direction. Thus, when the latch 140 is in the downward unlocked position, the handle 142 will be extended outwardly so that the operator can easily grab the middle portion 186 of the handle 140 and use it to pull the CRU 124 in the direction of arrow 136. It should be appreciated that the handle 142 needs to be so configured such that the center of mass $C_M$ of the handle 142 lies in a plane forward from the vertical plane intersecting the door handle axis 156. Such a forward center of mass on the upward handle can be accomplished in several ways. For example, recess face 186 of the recess 166 of the front cover 130 may extend outwardly in an upward vertical direction so that the center of mass of the handle 142 is forward of axis 156. Similarly, the handle 142 may be configured such that when the handle 142 is in a directly upward direction, the mass on the portion of the handle adjacent front face 174 of the handle 142 is greater than the mass adjacent the inner face 182 of the handle. This can be accomplished as shown in FIG. 2 by the use of a protrusion or tab 190 extending outwardly from the front face 174 of the handle 142. Preferably, the protrusion 190 is located near the door handle axis 156 so that the centerline of the handle 142 may be forward even if recess face 186 inclines rearwardly.

The protrusion 190 serves a second purpose as well. The protrusion 190 extends downwardly and rests against recess face 186 of the front cover 130 preventing the handle 142 from rotating further in the direction of arrow 184 so that the handle 142 extends out in a generally horizontal direction. The protrusion 190 thus serves as a stop to hold the handle 142 in a horizontal position.

By providing a cartridge replaceable unit which cooperates with a cooperating latch and handle, a CRU may be provided which provides easy removal by the operator.

By providing a cooperable latch and handle for use with a CRU, a handle may be retracted and extended with the rotation of the latch.

By providing a retractable handle with a protrusion, a handle may be provided that falls forward into a horizontal position for removal of the CRU.

By providing a cooperating latch and handle assembly for use with a CRU in which the latch includes a handle which extends past a pivotable handle, the motion of the latch may be used to retract the handle.

While the invention herein has been described in the context of black and white photoreceptor CRU, it will be readily apparent that the device can be utilized in electrophotographic printing machine in which ease of service and customer service ability is desired.

It is, therefore, apparent that there has been provided in accordance with the present invention, a CRU module that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A slidable subsystem for use in a printing machine, comprising:

body slidably mounted to the printing machine;

a handle connected to said body; and a lever operably associated with said body for selectively securing said body to the printing machine and for selectively releasing said body from the printing machine, said lever to be moveable into a first released position and a second secured position, said lever urging said handle toward a loading position as said lever is urged toward the released position and said lever urging said handle toward a storing position as said lever is urged toward the released position.

2. A slidable subsystem according to claim 1, wherein said lever is rotatable.

3. A slidable subsystem according to claim 1, wherein said handle and said lever are positioned on a recessed face of said body.

4. A slidable subsystem according to claim 1, wherein said handle is horizontally pivotally connected to said body and is so positioned relative to said body such that said handle is influenced by gravity so as to extend outwardly in a horizontal direction.

5. A slidable subsystem for use in a printing machine, comprising:

a body slidably mounted to the printing machine;

a handle horizontally pivotally connected to said body; and lever operably associated with said body for selectively securing said body to the printing machine and positioned so as to raise said handle as it is rotated in a first direction, said lever to be moveable into a first relaxed position and a second secured position, said lever cooperating with said handle to permit said handle to extend forwardly when said lever is in a relaxed position.

6. A slidable subsystem according to claim 5, wherein said handle further includes a protrusion for orienting said handle in a horizontal direction when said lever is not in contact with said handle

7. A customer replaceable unit for use in a printing machine, the printing machine including a lever, the customer replaceable unit comprising:

a body for mounting a component having a service life less than the printing machine; and a handle connected to said body; the lever operably associated with said body for selectively securing the body to the printing machine and for selectively releasing said body from the printing machine, the lever to be moveable into a first released position and a second secured position, the lever urging said handle toward a loading position as the lever is urged toward the released position and the lever urging said handle toward a storing position as the lever is urged toward the released position.

8. A customer replaceable unit according to claim 7, wherein the lever is rotatable.

9. A customer replaceable unit according to claim 7, wherein said handle and the lever are positioned on a recessed face of said body.

10. A customer replaceable unit according to claim 7, wherein said handle is horizontally pivotally connected to said body and is so positioned relative to said body such that said handle is influenced by gravity so as to extend outwardly in a horizontal direction.

11. A customer replaceable unit for use in printing machine, the printing machine including a lever, the customer replaceable unit comprising:

a body for mounting a component having a service life less than the printing machine; and a handle horizontally pivotally connected to said body, the lever operably associated with said body for selectively securing the body to the printing machine, the lever to be moveable into a first relaxed position and a second secured position, the lever positioned so as to raise said handle as it is rotated in a first direction, the lever cooperating with said handle to permit said handle to extend forwardly when the lever is in a relaxed position.

12. A customer replaceable unit according to claim 11, wherein said handle further includes a protrusion for orienting the handle in a horizontal direction when the lever is not in contact with the handle.

13. An electrophotographic printing machine of the type including a customer replaceable unit, the printing machine including a lever, the printing machine comprising:

a body for mounting a component having a service life less than the printing machine; and a handle connected to said body; the lever operably associated with said body for selectively securing the body to the printing machine and for selectively releasing said body from the printing machine, the lever to be moveable into a first released position and a second secured position, the lever urging said handle toward a loading position as the lever is urged toward the released position and the lever urging said handle toward a storing position as the lever is urged toward the released position.

14. A printing machine according to claim 13, wherein the lever is rotatable.

15. A printing machine according to claim 13, wherein said handle and the lever are positioned on a recessed face of said body.

16. A printing machine according to claim 13, wherein said handle is horizontally pivotally connected to said body and is so positioned relative to said body such that the handle is influenced by gravity so as to extend outwardly in a horizontal direction.

17. A printing machine of the type including a customer replaceable unit, the printing machine including a lever, the printing machine comprising:

a body for mounting a component having a service life less than the printing machine; and a handle horizontally pivotally connected to said body, the lever operably associated with said body for selectively securing the body to the printing machine, the lever to be moveable into a first relaxed position and a second secured position, the lever positioned so as to raise said handle as it is rotated in a first direction, the lever cooperating with said handle to permit said handle to extend forwardly when the lever is in a relaxed position.

18. A printing machine according to claim 12, wherein said handle further includes a protrusion for orienting said handle in a horizontal direction when the lever is not in contact with said handle.

* * * * *